United States Patent [19]

Owan

[11] 4,098,215

[45] Jul. 4, 1978

[54] STEERING CONTROL SYSTEM FOR HYDROFOILS

[75] Inventor: Thomas A. Owan, Kirkland, Wash.

[73] Assignee: The Boeing Company, Seattle, Wash.

[21] Appl. No.: 817,656

[22] Filed: Jul. 21, 1977

[51] Int. Cl.[2] ..... B63B 1/28

[52] U.S. Cl. ..... 114/275; 244/179; 244/184; 318/588

[58] Field of Search ..... 114/275; 244/179, 184, 244/196, 197; 318/328, 585, 588, 590, 591; 328/153; 307/264; 330/295, 51, 124 R

[56] References Cited

U.S. PATENT DOCUMENTS

| | | | |
|---|---|---|---|
| 3,137,260 | 6/1964 | Harris, Jr. et al. | 114/275 |
| 3,156,209 | 11/1964 | Ask | 114/275 |
| 3,886,884 | 6/1975 | Stark et al. | 114/275 |

*Primary Examiner*—Trygve M. Blix
*Assistant Examiner*—Sherman D. Basinger
*Attorney, Agent, or Firm*—Thomas H. Murray

[57] ABSTRACT

An improved steering control system is provided for improving the handling qualities of hydrofoil craft during takeoff. In steering control systems for hydrofoils, the craft is banked by operation of control surfaces and the rudder is turned in the corresponding direction to coordinate the turn. To improve the handling qualities and maneuverability during the period of acceleration from hull-borne to foil-borne operation, the steering control system is modified during this period by decreasing the gain of the control loop for the control surfaces and by increasing the gain of the control loop for the rudder. A lag filter is also introduced into both loops.

5 Claims, 6 Drawing Figures

STEERING CONTROL SYSTEM FOR HYDROFOILS

BACKGROUND OF THE INVENTION

The present invention relates to a steering control system for hydrofoil craft, and more particularly to a control system providing improved handling qualities and maneuverability during takeoff of such craft.

Hydrofoil craft have foils which are attached to the hull by struts and which move through the water below the surface when the craft is operated in the foil-borne mode. The foils develop lift in much the same manner as an aircraft wing and when a sufficiently high speed is attained they support the hull of the craft above the surface of the water. The craft is controlled by control surfaces or flaps pivotally mounted on the foils, or the foils themselves may be pivotally mounted on the struts to function as control surfaces, and a rudder is also provided for steering the craft. At low speeds, or when the struts are retracted to raise the foils from the water, the craft floats on the surface and operates in the hull-borne mode in the same manner as any other watercraft. When the struts are extended into the normal operating position and the craft is accelerated, lift is developed, as mentioned above, and when the craft has accelerated to a sufficient speed, typically between 30 and 40 knots, the hull is lifted above the surface and supported by the struts as long as the speed is maintained. During operation in this mode the control surfaces are automatically controlled in response to signals derived from suitable sensors and other control devices, and are positioned to maintain the desired attitude and direction of the craft and its height above the water to control and stabilize roll, pitch and yaw of the craft. A control system of this type is shown, for example, in Stark et al U.S. Pat. No. 3,886,884.

In the control system of the Stark et al patent, steering of the craft is controlled in response to command signals from a helm which may be either automatically controlled or controlled manually by the pilot. The signals generated by the helm when a turn is to be made actuate the aft control surfaces to rotate in opposite directions which causes the craft to bank about its roll axis in the direction of the desired turn. This rolling movement results in actuation of the rudder to make the turn and to achieve the desired turn coordination. The rudder could also, of course, be actuated directly in response to the helm command signals, if desired. It has been found in the use of this system that it is difficult to obtain good handling qualities and maneuverability during takeoff of the craft, that is, during the period of acceleration from the hull-borne mode to the foil-borne mode. Good maneuverability is particularly important during takeoff because it frequently occurs in locations such as harbor channels, where room to maneuver is limited and where traffic may be quite heavy so that rapid response to the helm and good maneuverability are important.

Both rate of turn and coordination of turns are important to good handling. It is desirable to have a relatively high rate of turn of the craft available when needed, and good coordination of turns is also highly desirable for good maneuverability and control. Coordination refers to the relation of the rotational, rolling, gravitational and other forces acting on the craft during a turn and can best be expressed in percent. Thus, 100% coordination refers to a condition in which the normally vertical resultant force acting on the craft maintains its perpendicular relation to the transverse axis of the craft during a turn even though the transverse axis itself departs substantially from the horizontal. Coordination is important not only to minimize passenger discomfort during a turn, but also because highly over- or under-coordinated turns increase the probability of strut ventilation. This is a condition in which the strut actually separates from the water, creating a vacuum or low-pressure space adjacent the strut which adversely affects the control and maneuverability of the craft.

SUMMARY OF THE INVENTION

The present invention provides an improved steering control system of the general type disclosed in the abovementioned Stark et al patent but in which substantially improved handling qualities and maneuverability during the takeoff period are obtained.

In the prior system control loops are provided responsive to command signals from the helm to actuate servos for operating the control surfaces or flaps and the rudder. These control loops include scaling or amplifier networks for determining the response of the system and a filter is also provided in the control surface loop. In accordance with the present invention, this prior system is modified by including means for changing the gains of the respective control loops during takeoff of the craft in such a manner that the gain of the loop for the control surfaces is decreased while the gain of the rudder control loop is increased. A lag filter is also introduced into both control loops during this period. The necessary switching can readily be performed by inserting suitable networks into the control loops by additional switch contacts on the takeoff controller which is normally used in such systems for other purposes. Changing the gains in the steering control system in this manner during takeoff results in a very substantial improvement in maneuverability and handling qualities of the craft by increasing the maximum rate of turn obtainable and by greatly improving the turn coordination.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
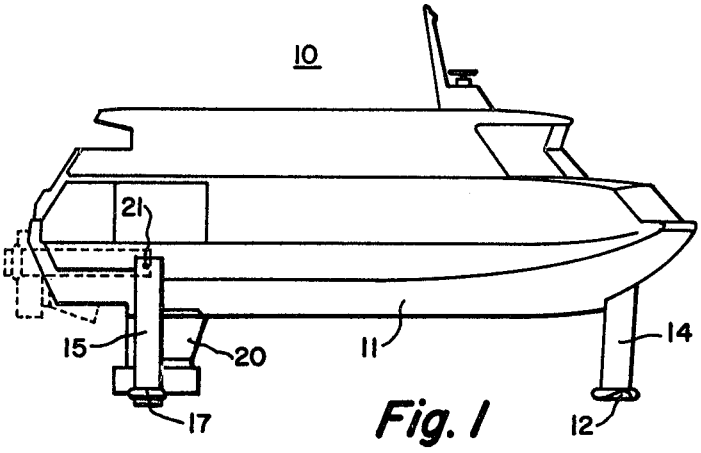
FIG. 1 is a side view of a typical hydrofoil craft.
Figure 2:
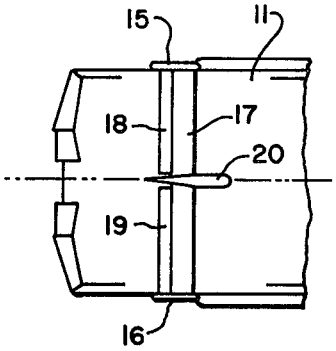
FIG. 2 is a bottom view of the aft portion of the craft of FIG. 1.

There is shown in FIGS. 1 and 2 of the drawing a typical hydrofoil craft 10 having a hull 11 of any suitable construction. A forward foil 12 is attached to a hull by a forward strut 14, and the strut 14 is mounted for pivotal movement about a vertical axis to serve as a rudder. Aft struts 15 and 16 are pivotally attached to the hull 11 on the aft portion, and carry a foil system consisting of a foil 17 extending between the struts with separate starboard and port control surfaces 18 and 19. The control surfaces or flaps 18 and 19 are pivotally mounted on the foil 17 and are individually controlled to move upward and downward independently of each other. A similar control flap is provided on the forward foil 12. Any suitable propulsion system may be utilized, such as a water-jet system represented by the water intake structure 20 supported on the aft foil system. The struts are pivotally mounted on the hull so that the aft struts 15 and 16 and the aft foil system can be rotated to the retracted position shown in dotted outline in FIG. 1, while the forward strut 14 may be similarly rotated in the forward direction to a retracted position.

When the struts are in the extended position shown, with the foils submerged in water, the craft can be accelerated, and when it has reached a sufficiently high speed, the foils develop the necessary lift to raise the hull above the water surface for operation in the foil-borne mode. The craft is then controlled by movement of the control surfaces 18 and 19 which control roll and pitch of the craft by the control surface on the forward foil 12 which controls the height of the craft above the water. As previously mentioned, the forward strut 14 is rotatable about a vertical axis to serve as a rudder. The various control surfaces can, of course, be used for any desired function and can be controlled in any desired manner to control the craft and stabilize its motion.

In the control system disclosed in the above-mentioned Stark et al patent, various sensors and accelerometers are utilized to sense the motions and attitude of the craft and to generate signals to position the control surfaces in a manner to stabilize the motion of the craft and to control its movement. In particular, the system includes a steering control system which responds to command signals from the helm. When a turn is to be made, the helm is positioned to generate a signal which causes the aft control surfaces 18 and 19 to move in opposite directions so that the craft banks about its roll axis in the direction of the desired turn. In the system as disclosed this rolling motion of the craft results in a signal to the rudder which causes it to turn in the desired direction. It will be understood, of course, that in such a system the rudder can respond directly to the helm command signals rather than indirectly in response to banking of the craft. As previously discussed, it has been found that while this system works well during normal foil-borne operation, it is difficult to obtain good handling qualities and maneuverability during takeoff, that is, during the period of acceleration from hull-borne operation to foil-borne operation.

Figure 3:
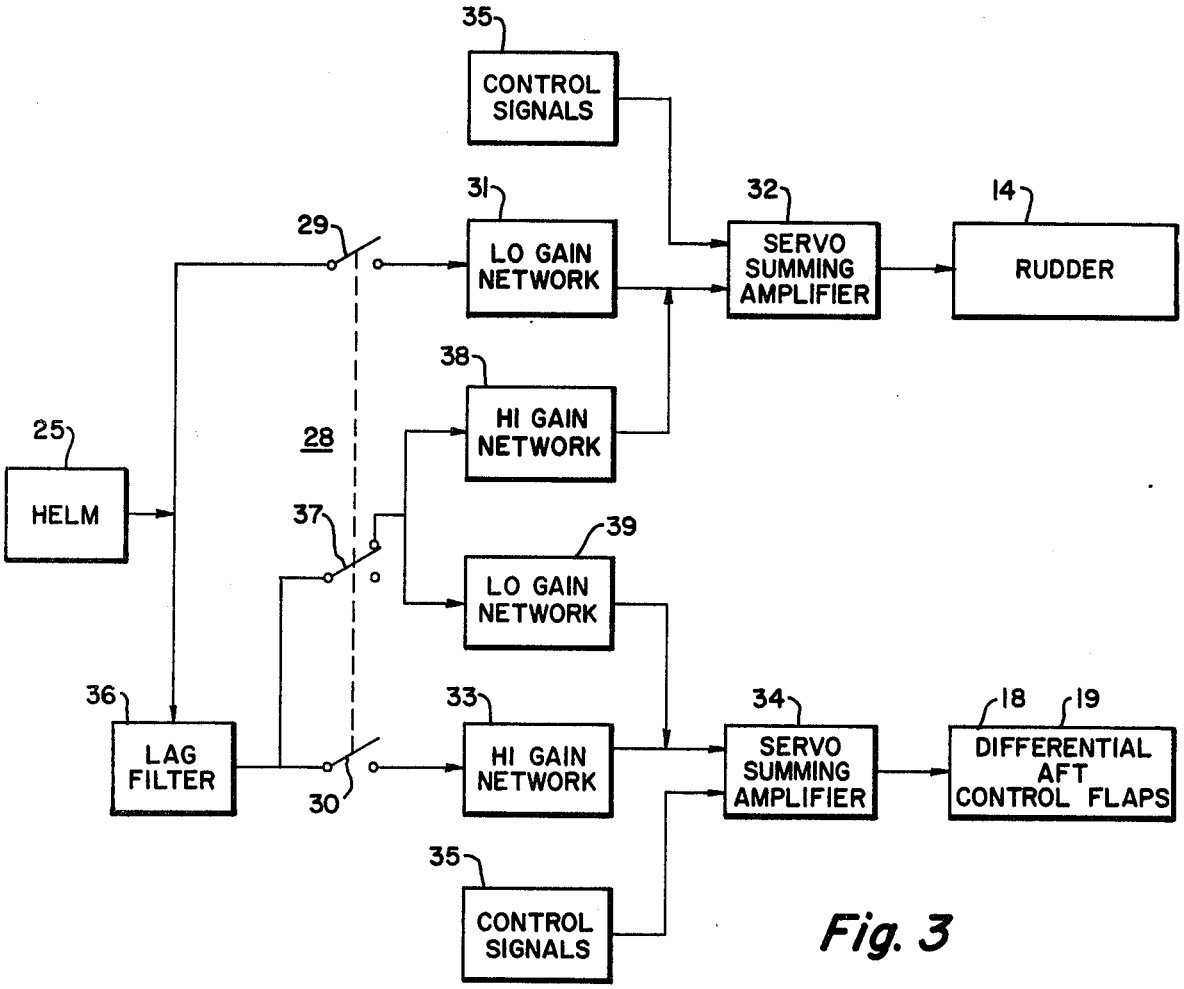
FIG. 3 is a block diagram illustrating the control system of the present invention.

In accordance with the present invention, the steering control system described above is modified in the manner illustrated in FIG. 3 to obtain a substantial improvement in maneuverability of the craft during takeoff. As there shown, the command signals are generated by a helm 25 and transmitted through a three-pole switching means 28 which may desirably be incorporated in a takeoff controller by adding the necessary additional contacts thereto. Such takeoff controllers are normally used in control systems of this type for changing the bias of the control surfaces during takeoff to increase the foil lift. The switching means 28 could, however, be a separate switch or controller of any desired type. The switch 28 is shown in the drawing in its takeoff position. During normal foil-borne operation, however, the upper and lower contacts 29 and 30 are closed and the center contact 37 is open. The helm command signals are thus transmitted through the contact 29 and a scaling or amplifier network 31 to a summing amplifier 32 which controls a servo to actuate the rudder 14. The helm signals are also transmitted through contact 30 and a scaling or amplifier network 33 to a summing amplifier 34 which controls servos for actuating the aft control surfaces 18 and 19 which move differentially, that is, in opposite directions. The amplifiers 32 and 34 are summing amplifiers which also receive other signals from the control system, as indicated at 35, to carry out the necessary control and stabilizing functions, in addition to steering. The complete control system may be as shown in the Stark et al patent, or any suitable system could be used. A lag filter 36 is included only in the control loop for the aft control surfaces during foil-borne operation.

This control system operates in the manner previously described to bank the craft by means of the aft control flaps and to turn the rudder to the extent required to achieve the desired turn coordination, and provides smooth and easily-controlled turning capability during normal foil-borne operation. It has been found, however, as previously discussed, that it is difficult to obtain the desired maneuverability and handling qualities during takeoff. The desired characteristics can be attained in accordance with the invention by modifying the control system as shown in FIG. 3 to change the gains during takeoff. Thus, when the switch 28 is placed in the takeoff position shown in the drawing, the contacts 29 and 30 are open and the center contact 37 is closed to connect a different amplifier network 38 in the rudder control loop and a different network 39 in the control surface loop. As indicated on the drawing, the takeoff network 38 in the rudder control loop has a high gain as compared to the normally-used low gain network 31, while the takeoff network 39 for the control surface loop is a relatively low gain network as compared to the high gain network 33 normally used. The terms high and low are, of course, relative and are to be taken only as indicating the values of the gains of the respective networks relative to each other. More specifically, in an actual embodiment of the invention, the low gain network 31 of the rudder control loop had a gain of 0.0139 while the high gain network 38 had a gain of 0.078, or almost six times that of the low gain network. The high gain network 33 normally used in the control surface loop had a gain of 0.37 while the low gain network 39 had a gain of 0.164, or a decrease of about 45%. In addition to changing the gains of the control loops, the lag filter which is normally used only in the control surface loop is inserted by closure of the contact 37 into both loops during takeoff so as to affect both the control surface response and the rudder response. The filter 36 may be a first order lag filter of suitable characteristics, and it has been found that a filter of this type with a break frequency of 1 rad/sec gives satisfactory results. The effect of this filter is to somewhat slow the response of the higher command signal levels, corresponding to high rates of turn, and thus improve the smoothness of the turn.

Figure 4:
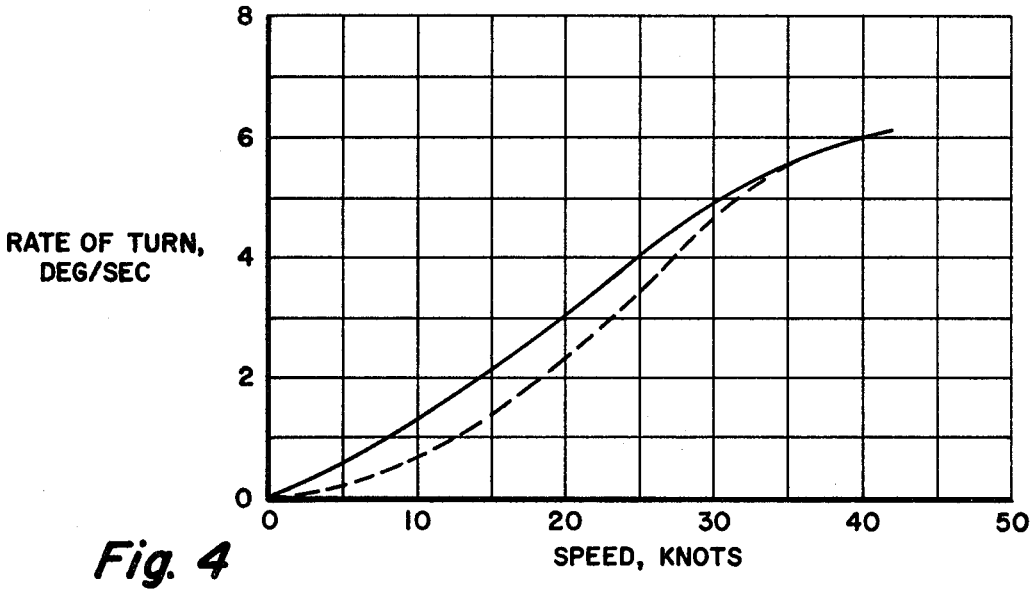
FIGS. 4, 5 and 6 are curves showing the improved results obtained.
Figure 5:
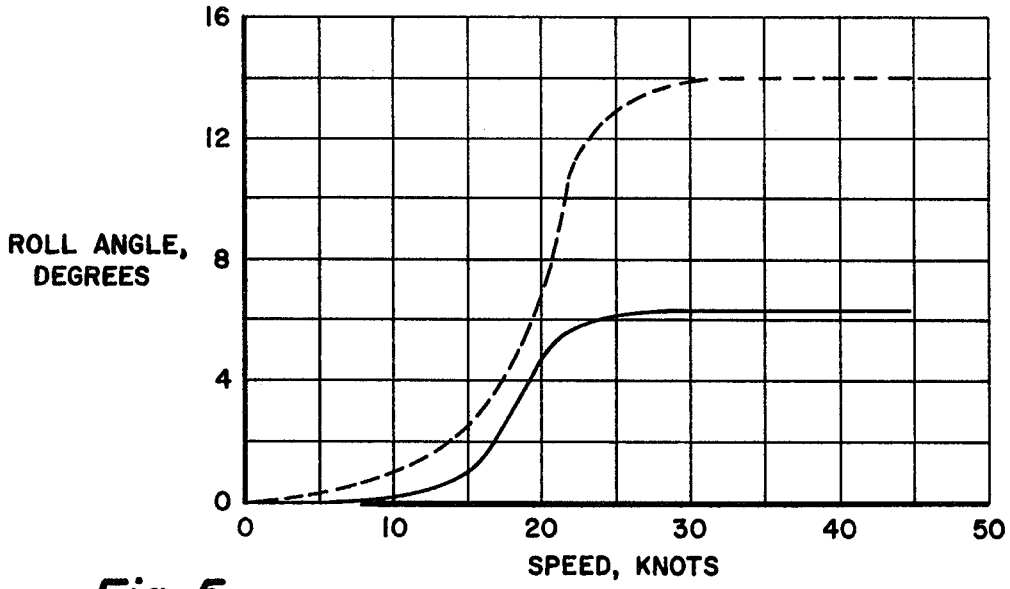
Figure 6:
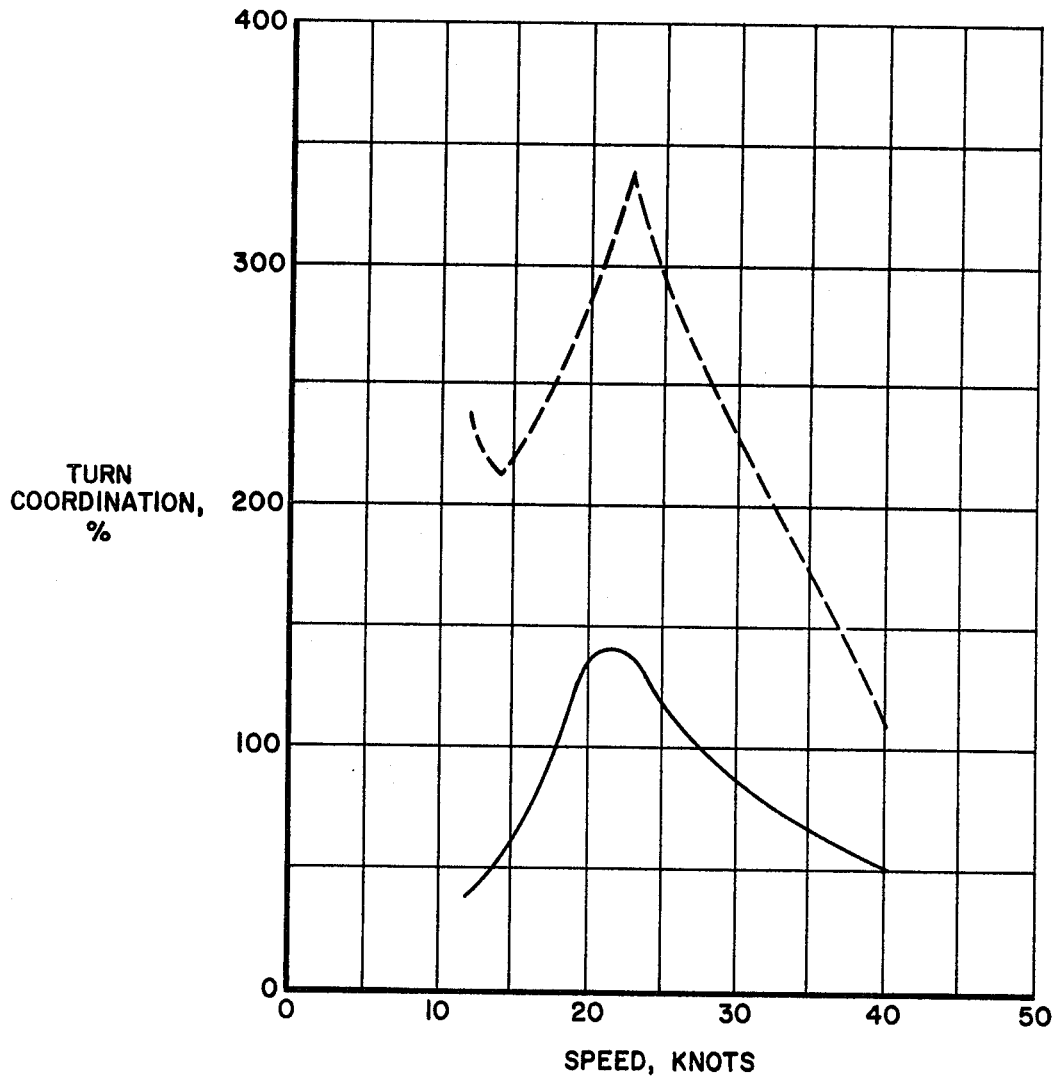

The effect of modifying the steering control system in the manner described is illustrated in FIGS. 4, 5 and 6, in each of which the dashed curve represents operation during takeoff with a system having the nominal or usual gains for normal foil-borne operation, while the solid curve represents the operation when the system is modified as described above. The speeds indicated represent the range of speeds during acceleration to the foil-borne mode which is usually attained at approximately 35 knots. FIG. 4 shows the rate of turn obtainable with the maximum helm setting. It will be seen that by changing the gains of the control loops in the manner described the maximum rate of turn obtainable is almost doubled at the lower speeds and is substantially increased throughout the entire speed range up to about 35 knots when the maximum turn rate of 6 deg/sec is attained by both modified and unmodified systems. At this point the takeoff period is usually completed and takeoff controller is actuated, moving the switch 28 to its position for normal foil-borne operation. As shown in FIG. 5, the peak roll angle during takeoff is decreased from about 14° to 6.3°. The increase in rate of turn obtainable, together with the marked decrease in the roll angle, results in a great improvement in maneuverability and handling of the craft as well as increased passenger comfort. FIG. 6 shows the effect of the modified control loop networks on turn coordination. It will be seen that the peak coordination occurs at about 21 knots but has been reduced for 340% to 140% at the peak which is a very great improvement and the problem of highly overcoordinated turns is greatly alleviated, while coordination variation over the speed range has been substantially reduced. Turn coordination decreases below 100% at the higher speeds which is somewhat undesirable since undercoordinated turns tend to increase the probability of strut ventilation, but this is not a serious problem since the takeoff controller is normally disengaged at about 35 knots and the system is then restored to its normal foil-borne operation condition.

I claim as my invention:

1. In a steering control system for a hydrofoil craft having a foil system and a rudder, the foil system including separately movable control surfaces, and said craft being adapted for operation in a hull-borne mode and a foil-borne mode, said control system including helm means for generating command signals to effect turning of the craft, a first control loop responsive to said command signals for causing said control surfaces to move in opposite directions to cause the craft to bank about its roll axis, a second control loop responsive to said command signals for turning said rudder, each of said control loops including amplifier means, and means for decreasing the gain of the first loop and increasing the gain of the second loop during acceleration of the craft from the hull-borne mode of operation to the foil-borne mode.

2. A control system as defined in claim 1 in which each of said control loops has two amplifier networks with different gains, and switching means for connecting the network of lower gain in the first loop and the network of higher gain in the second loop during acceleration of the craft from hull-borne operation to foil-borne operation, and for connecting the other network of each loop in the respective loops during other conditions of operation.

3. A control system as defined in claim 2 in which one amplifier network of the first loop has a gain of about 45% less than the other network of the first loop and one amplifier network of the second loop has a gain of about six times that of the other network of the second loop.

4. A control system as defined in claim 2 including a lag filter network, and in which said switching means connects said filter network in both control loops during acceleration of the craft from hull-borne operation to foil-borne operation and connects the filter network in the first control loop only during other conditions of operation.

5. A control system as defined in claim 1 including a lag filter network, and means for connecting said filter network in both control loops during acceleration of the craft from hull-borne operation to foil-borne operation and for connecting the filter network in the first control loop during other conditions of operation.

* * * * *